US006324777B1

(12) United States Patent
Ngan

(10) Patent No.: US 6,324,777 B1
(45) Date of Patent: Dec. 4, 2001

(54) STATIC CLING CALENDAR

(76) Inventor: Chi Lung Ngan, 5 Bradford Rd., Edison, NJ (US) 08820

( * ) Notice: Subject to any disclaimer, the term of this patent is extended or adjusted under 35 U.S.C. 154(b) by 2 days.

(21) Appl. No.: 09/595,877

(22) Filed: Jun. 20, 2000

(51) Int. Cl.[7] ..... G09D 3/00

(52) U.S. Cl. ..... 40/107; 40/191; 40/594; 221/210; 283/2

(58) Field of Search ..... 40/594, 107, 119, 40/121; 283/2, 3, 4; 221/210

(56) References Cited

U.S. PATENT DOCUMENTS 2,032,150 2/1936 Richardson .
3,883,971 5/1975 Weiss .
4,285,114 8/1981 Underdahl .
5,010,671 * 4/1991 Stonehouse ..... 40/594
5,123,191 6/1992 Kim .
5,848,316 12/1998 Clough .

* cited by examiner

*Primary Examiner*—Cassandra H. Davis
(74) *Attorney, Agent, or Firm*—Shlesinger, Arkwright & Garvey LLP

(57) ABSTRACT

A static cling calendars and the like which provides an electrostatic swingable cover which will attract a sheet underlying the cover so that when the cover is swung, the underlying sheet will be picked up by the cover to expose the underside of the sheet as well as the next succeeding sheet.

9 Claims, 3 Drawing Sheets

STATIC CLING CALENDAR

FIELD OF THE INVENTION

This invention pertains to calendars and the like in which the top cover carries an electrostatic charge which will pick up the underlying sheet and lift it from the successor sheets when the top cover is swung upwardly for viewing of the underside of the underlying sheet.

BACKGROUND OF THE INVENTION

Richardson U.S. Pat. No. 2,032,150 discloses means for lifting sheet material from a stack or pile by a top sheet having an adhesive thereon. When the top sheet is swung upwardly, the underlying sheet adheres to the top sheet and is picked up thereby.

Clough U.S. Pat. No. 5,848,316 shows the idea of providing an electrostatic charge to a strip of material for removing a second strip by electrostatic attraction.

Underdahl U.S. Pat. No. 4,285,114 shows a device for picking up discs using electrostatic means in which an applicator 10 is placed down on a stack to remove a member from the stack.

Weiss U.S. Pat. No. 3,883,971 discloses a-year-at-a-glance memo calendar with a top member, which when lifted, exposes calendars underneath automatically due to the accordion affect. Kim U.S. Pat. No. 5,123,191 shows a calendar display plastic holder of transparent vinyl material in which a calendar is inserted. Since the corners of the calendar are locked in pockets, the vinyl cover cannot lift the pages of the calendar.

OBJECTS AND SUMMARY OF THE INVENTION

It is an object of this invention to provide a calendar pad or the like in which the top cover is transparent and statically clings to the first undersheet so that the undersheet will cling to the cover when it is swung upwardly to view the underside of the sheet.

Another object of this invention is to provide a calendar, pad or the like which is inexpensive to manufacture and is pleasing to the eye.

A further object of this invention is to provide a calendar pad or the like which has indicia on the both the front and back of the sheets and which calendar pad or the like is provided with means for lifting the top sheet to expose the underside thereof so that the indicia can be viewed readily.

Yet another object of this present invention is to provide a calendar or pad or the like which is inexpensive to manufacture.

A further object of this invention is to provide a calendar or pad or the like which provides indicia on the cover sheet which will overlie a blank on the undersheet so that in printing, the cover sheet can be separately printed with the advertisers name and address without having to print the same on each individual sheet of the calendar.

In summary, this invention relates to a calendar or pad or the like in which electrostatic means is used to raise the top sheet of the calendar or pad or the like so that the underside of the top sheet of the pad or the like can be readily viewed due to the swinging action of the cover which is hingedly connected to the sheets.

These and other objects of the invention will be apparent from a study of the following description including the drawings in which:

DESCRIPTION OF THE DRAWINGS

In FIGS. 1–4, the calendar C, which could be a pad or other similar device comprising a cover 2 which is transparent and of vinyl or acrylic plastic. Calendar C includes a series of monthly sheets 4 which are stacked and of substantially the same dimension as the cover 2. A back 6 is provided to give regidity to the calendar C. The back 6 is of cardboard or some stiffer material than the sheets 4 which would generally be of paper. The cover 2 may be provided with advertising graphics and indicia 8. Monthly sheets 4 have a front 9 and a back 10. Since the cover sheet 2 is transparent, the graphics or indicia 8 will override a blank portion 11 on the front 9 of sheets 4. This permits the calendar sheets 4 to be printed up in advance and organized with the back 6 and the cover sheet 2, so that only one advertising printing need be made to the cover sheet 2 to indicate the name of the advertiser. The front 9 and the back 10 of the sheets 4 will have indicia and/or advertising with standard printing thereon which is universally acceptable to all clients.

Figure 1:
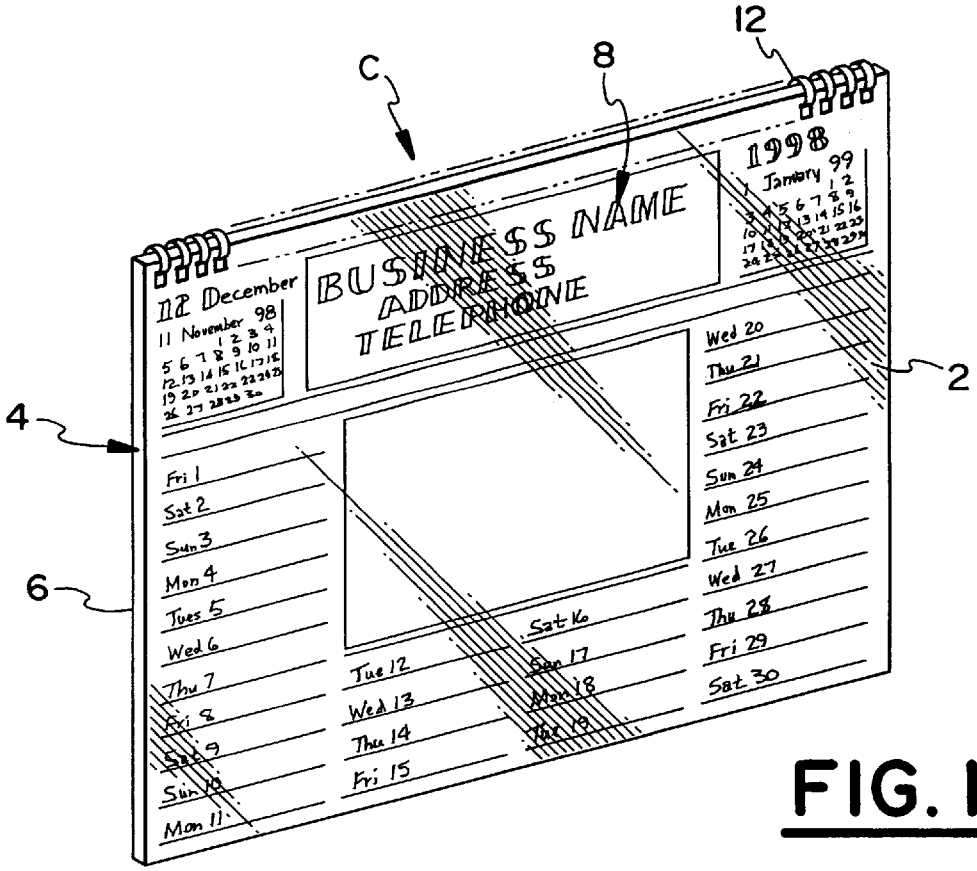
FIG. 1 is a perspective view of the invention.
Figure 4:
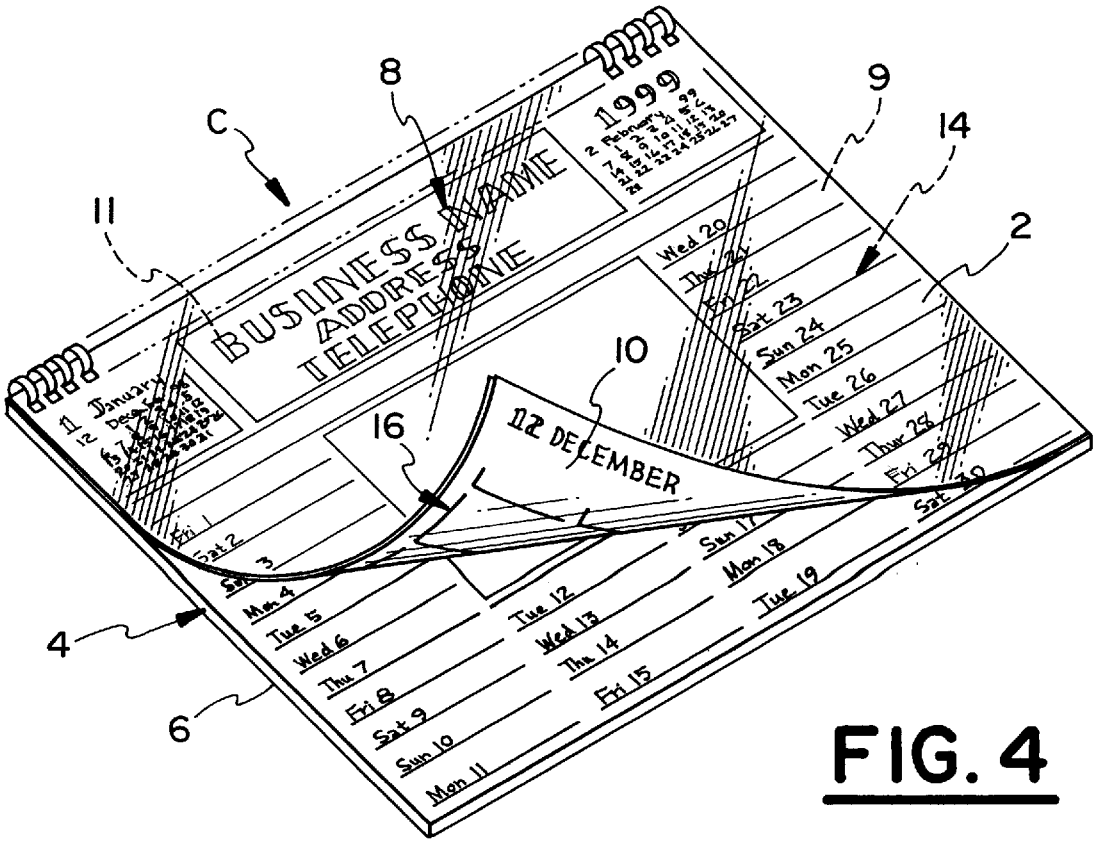
FIG. 4 is a perspective view of the invention with the transparent sheet raised partially and shown lifting the top calendar sheet.
Figure 2:
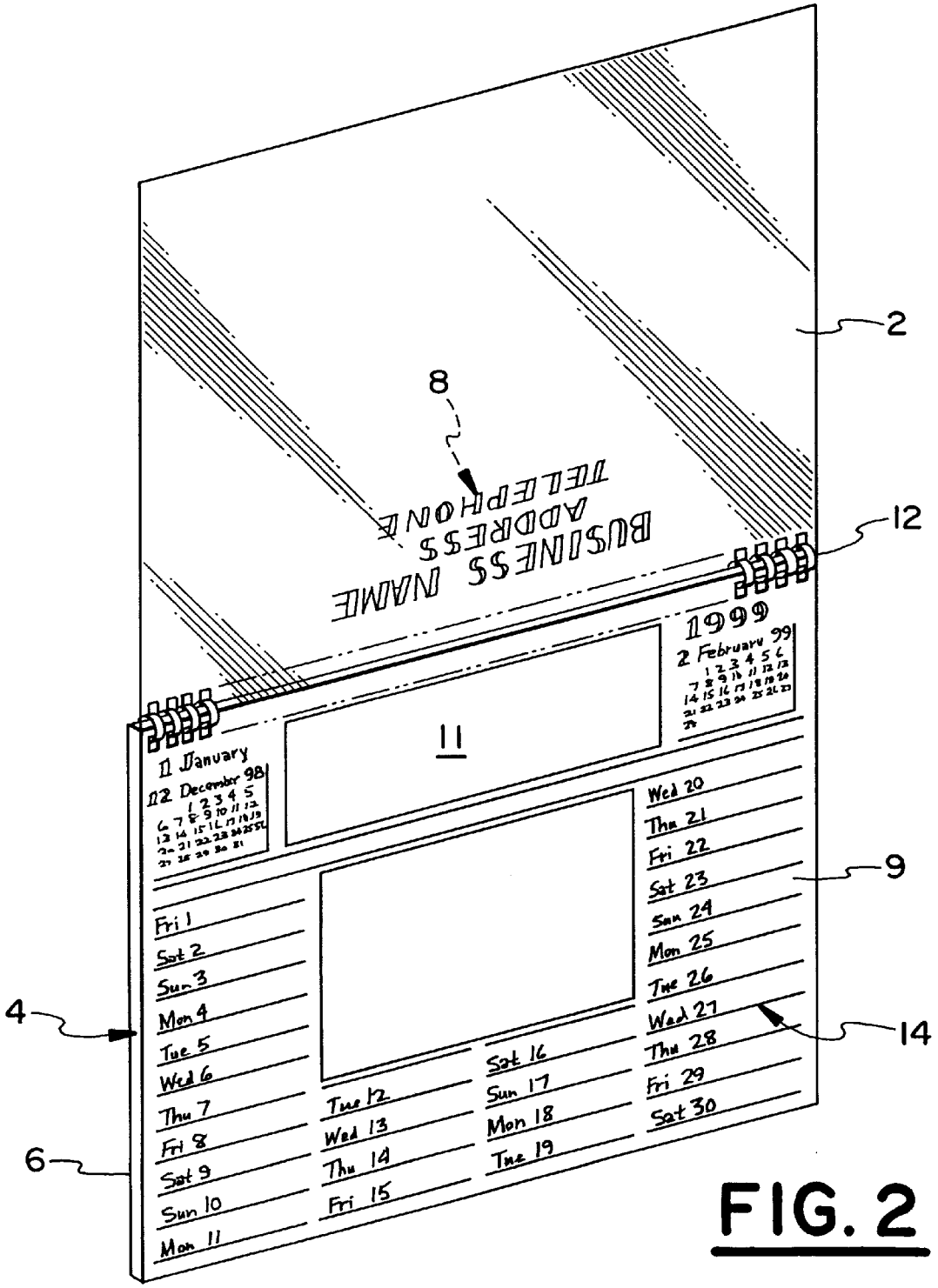
FIG. 2 is a perspective view of the invention showing the cover raised.
Figure 3:
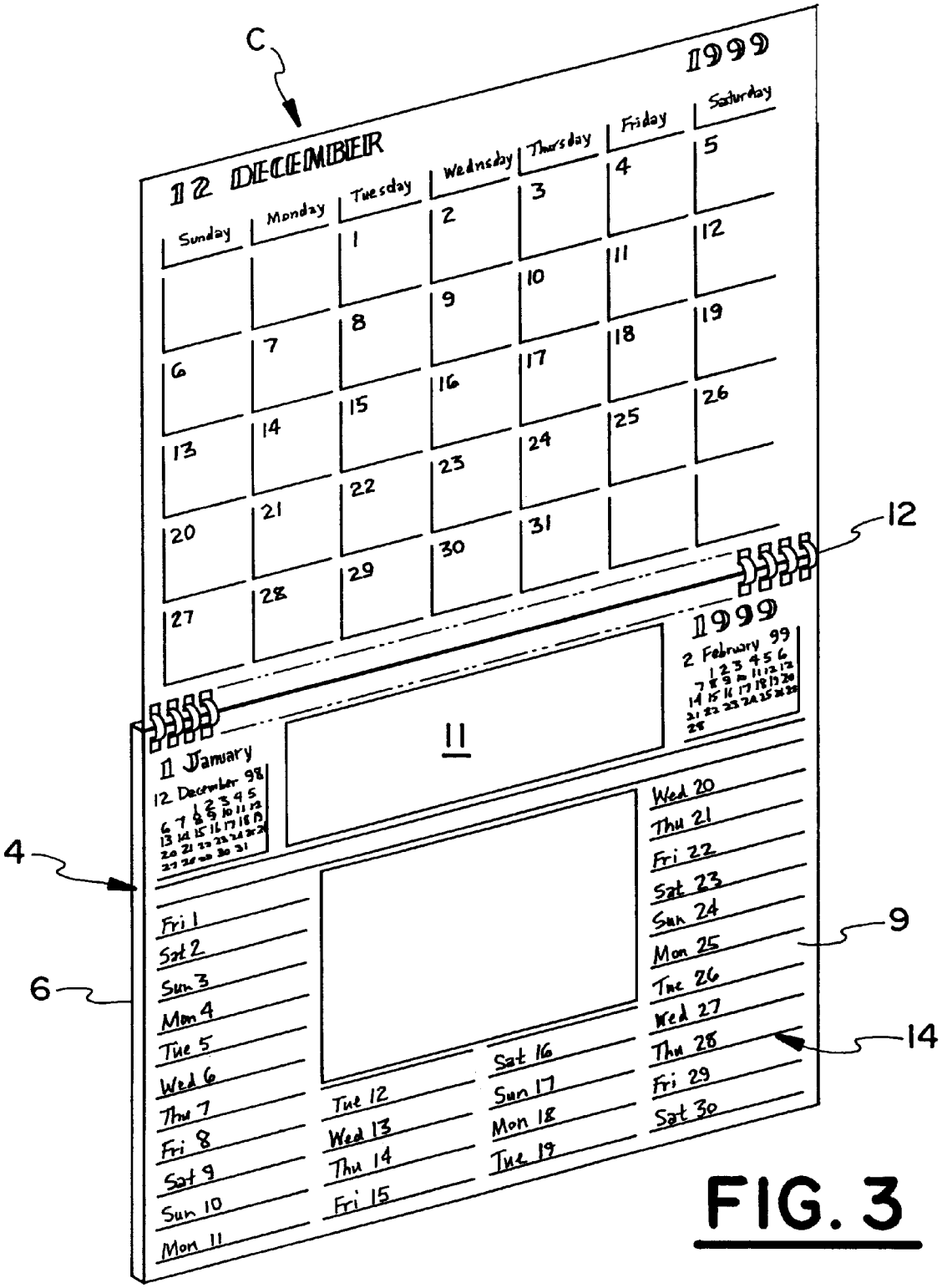
FIG. 3 is a perspective view of the invention showing the top calendar sheet raised.

The cover 2, the monthly sheets 4 and back 6 are all interconnected by a hinge 12 which would permit the cover 2 to be raised at least to about 90° so that the underlying calendar sheet 4 will be attracted to the cover 2 as it is swung upwardly to at least about 90° for exposure of the underside of the attracted sheet 4. Each of the sheets 4 can be torn or otherwise removed from the hinge 12 as successive sheets are brought into position beneath the cover 2.

It will be noted that the monthly sheets 4 include a calendar indicia format 14 on the front 9 of the monthly sheets 4 and a differing calendar indicia format 16 on the back 10 of sheets 4. In the case of a calendar C, the usual 12 months indicia will be placed on monthly sheets 4 and between cover 2 and back 6.

In general, the plastic, such as acrylic or vinyl composition has negative charges collected thereon which attract the positive charges collected on the paper of the monthly sheets 4. Since unlike charges attract, the electrical charge on the cover sheet 2 will attract the electrical charge on the top monthly sheet 4 and pick it up when it is raised. While the cover sheet is of plastic and acrylic or vinyl material, it is obvious that there are other plastic materials which carry an electrostatic charge and can be utilized, which will attract monthly sheets 4 of paper but which may be of some other material which would carry the opposite charge to the cover sheet, so that the two will be attracted to each other.

The hinge 12 as illustrated is of a wire type readily available, but may be of other hinge material such as plastic or rings or the like.

While this invention has been described as having a preferred design, it is understood that it is capable of further modification, uses and/or adaptations following in general the principles of the invention and including such departures from the present disclosure as come within known or customary practice in the art to which the invention pertains, and as may be applied to the essential features set forth, and fall within the scope of the invention or the limits of the appended claims.

What is claimed is:

1. A static cling calendar, comprising:

a) a swingable cover;

b) a series of stacked similar sheets each having indicia thereon including a cover underlying first sheet and at least one first sheet underlying second sheet;

c) said swingable cover normally overlying said stacked sheets and having a dimensional size substantially the same as said stacked sheets;

d) said swingable cover being of electrostatic material and carrying on electrostatic charge;

e) said stacked similar sheets being of electrostatic material and carrying an electrostatic charge opposite to said electrostatic charge of said cover;

f) said swingable cover and said stacked similar sheets each having an adjacent corresponding side edge;

g) said swingable cover and said stacked similar sheets swingably connected at their said adjacent corresponding side edges;

h) whereby when said swingable cover is brought into contact with said cover underlying first sheet and said swingable cover is swung, said swingable cover and only said cover underlying first sheet are electrostatically adhered to one another and as said cover and said underlying first sheet are moved away from said at least one first sheet underlying second sheet to reveal the indicia on said at least one first sheet underlying second sheet.

2. A static cling calendar, as in claim 1 and wherein:

a) said swingable cover is electrostatically charged plastic, and, b) said stacked similar sheets are oppositely electrostatically charged paper.

3. A static cling calendar, as in claim 1 and wherein:

a) said swingable cover is transparent.

4. A static cling calendar, as in claim 1 and wherein:

a) a back underlying said series of stacked similar sheets and having a overall dimension substantially the same as said stacked sheets.

5. A static cling calendar, as in claim 1 and wherein:

a) said swingable cover is a plastic selected from the group consisting of vinyl and acrylic electrostatic compounds.

6. A static cling calendar, as in claim 1 and wherein:

a) said stacked similar sheets have a front and back;

b) said stack of similar sheet indicia is on both front and back.

7. A static cling calendar, as in claim 6 and wherein:

a) said stacked similar sheets each have an area without indicia on said front, and;

b) said swingable cover is transparent and has indicia thereon overlying said area without indicia on said stack of similar sheets.

8. A static cling calendar, as in claim 6 and wherein: a) said indicia includes a first calendar format on said front of said stacked similar sheets, and;

b) said indicia includes a second calendar format on said back of said stacked similar sheets.

9. A static cling calendar, as in claim 1 and wherein:

a) said swingable cover swings through an angle of at least about 90°.

* * * * *